US005845863A

United States Patent [19]

Takubo et al.

[11] Patent Number: 5,845,863

[45] Date of Patent: Dec. 8, 1998

[54] WINDING APPARATUS FOR SIMULTANEOUS WINDING OF TWO CRT YOKES

[75] Inventors: Hiroyuki Takubo, Kanagawa; Hideaki Kawaura, Chiba, both of Japan

[73] Assignee: Sony Corporation, Japan

[21] Appl. No.: 742,831

[22] Filed: Oct. 31, 1996

[30] Foreign Application Priority Data

Nov. 30, 1995 [JP] Japan ..... 7-311562

[51] Int. Cl.[6] ..... B65H 81/06

[52] U.S. Cl. ..... 242/437.1; 242/439.4; 242/432.6; 242/448; 29/596; 414/225

[58] Field of Search ..... 242/437, 437.1, 242/437.3, 448, 439.4, 440, 432.4, 432.6, 433.3, 432, 433; 29/596, 605; 414/225

[56] References Cited

U.S. PATENT DOCUMENTS

| | | | |
|---|---|---|---|
| 2,987,100 | 6/1961 | Strickland et al. | 242/437 X |
| 3,128,056 | 4/1964 | Fahrbach | 242/439.4 X |
| 3,334,825 | 8/1967 | Friedrich | 242/432.6 X |
| 3,938,748 | 2/1976 | Camardella | 242/440 |
| 3,976,256 | 8/1976 | Haslau et al. . | |
| 4,320,564 | 3/1982 | Aida et al. | 242/433.3 X |
| 4,572,446 | 2/1986 | Leonard et al. | 242/437.3 |
| 4,754,248 | 6/1988 | Belica | 242/437.1 X |
| 5,622,331 | 4/1997 | Kosaka et al. | 242/437.3 |

FOREIGN PATENT DOCUMENTS

| | | | |
|---|---|---|---|
| 0 510 226 | 10/1992 | European Pat. Off. . | |
| 0 596 628 | 5/1994 | European Pat. Off. . | |
| 358182456 | 10/1983 | Japan | 242/440 |
| 401007453 | 1/1989 | Japan | 242/437.3 |

*Primary Examiner*—Donald P. Walsh
*Assistant Examiner*—Emmanuel M. Marcelo
*Attorney, Agent, or Firm*—Ronald P. Kananen

[57] ABSTRACT

A winding apparatus capable of improving productivity includes a plurality of sets of winding devices each comprising a nozzle unit and a guide unit, and a plurality of holder for holding a plurality of bobbins in a predetermined posture so that the bobbins are wound with wires parallelly and simultaneously. Further, the nozzle units and the guide units of the plurality of winding devices are arranged on the same guide rails and the supply and winding of the wires are synchronized with the rotation of the holders. Moreover, each of the bobbins used in the winding apparatus is substantially funnel-shaped with the formation of a tapered outer peripheral surface having a projection so that the holders can securely hold the bobbin while positioning the bobbin through this projection. This winding apparatus is suitable for obtaining a saddlelike coil by winding a wire on a deflection yoke bobbin.

12 Claims, 9 Drawing Sheets

WINDING APPARATUS FOR SIMULTANEOUS WINDING OF TWO CRT YOKES

BACKGROUND OF THE INVENTION

The present invention relates to a winding apparatus and more particularly to such type of apparatus that winds a wire from a wire supply source around a bobbin through a nozzle unit and a guide unit. The apparatus is suitable for obtaining a saddlelike coil around a bobbin of a deflection yoke.

The TV receiver has a deflection yoke coil attached to the neck portion of the CRT (cathode ray tube) thereof. A deflection yoke coil comprises a saddlelike coil formed of an insulating enamel-coated wire around a synthetic resin bobbin.

In order to wind such saddlelike coil forming the deflection yoke coil, the conventional winding apparatus has been so constructed that the wire is wound along the winding groove inside the bobbin by a combination of the movement of a nozzle unit for guiding the wire in the direction of axis of the bobbin and the movement of a guide for guiding the wire in the radial direction of the bobbin with the rotation of the bobbin thereby forming a horizontal deflection yoke coil. The terminating end of the wire around the winding groove of the bobbin is hooked by a hooking pin embedded in the outer peripheral surface of the bobbin.

In the winding apparatus for manufacturing such a conventional deflecting yoke coil, the winding of the wire around the bobbin is performed by a single spindle operation. Accordingly, where the amount of production is required to increase, it is necessary to prepare a plurality of units of such apparatus.

In the case of the winding apparatus based on such single spindle operation, when the wire of the deflection yoke coil is wound, it is necessary to prepare a plurality of units of the winding apparatus for increasing the amount of production at the winding section which results in increasing the initial cost and giving rise to the problem of decreasing the space efficiency.

SUMMARY OF THE INVENTION

The present invention has been made to solve such problem and an object of the present invention is to provide a winding apparatus which is capable of obtaining productivity of several times that of the conventional winding apparatus without using additional units of the apparatus.

For achieving the above-mentioned object, a first aspect of the present invention concerns a winding apparatus for winding a wire paid out from a wire supply source around a bobbin through a nozzle unit and a guide unit, which apparatus is characterized by the provision of a plurality of sets of winding means comprising a nozzle unit and a guide unit and a plurality of holding means corresponding respectively to the winding means so as to hold a plurality of bobbins in a predetermined posture, whereby the plurality of bobbins are wound with wires parallelly with each other simultaneously.

For example, when the wires from the wire supply source are wound around the plurality of bobbins through the plurality of nozzle units, the winding apparatus provided with the plurality of guide units for guiding the wires and the plurality of holding means each provided with a wire clamping mechanism according to necessity is additionally provided with a wire hooking mechanism whereby the plurality of bobbins are respectively wound with the wires by the cooperative operation of the nozzles of the nozzle units, the wire clamping mechanisms and the holding means.

A second aspect of the present invention concerns a winding apparatus wherein each of the above-mentioned winding means has the nozzle unit and the guide unit arranged on the same guide rails such that each of the nozzle units is arranged on the side of the center of each of the bobbins while each of the guide units is arranged on the side of the outer peripheral surface of the bobbin so that each of the wires is supplied from the nozzle unit and the supplied wire is brought into engagement with the bobbin thereby winding the wire around the bobbin.

Preferably, the plurality of winding means may be such that each of the winding means comprises a nozzle unit and a guide unit both of which are respectively attached to drive units, the nozzle unit and the guide unit are arranged forward and rearward, respectively, and the supply and winding of the wires are performed in synchronism with the rotation of holding means for holding the bobbins to thereby wind the wires around the bobbins simultaneously.

A third aspect of the present invention concerns a winding apparatus characterized in that the apparatus is provided with a pair of winding means each comprising a nozzle unit and a guide unit such that the nozzle units of the pair of winding means are supported on a first movable body capable of coming close to, and leaving away from, each of the bobbins in bilateral symmetry with respect to the moving direction thereof and the guide units of the pair of winding means are supported on a second movable body capable of coming close to, and leaving away from, each of the bobbins in bilateral symmetry with respect to the moving direction thereof.

A fourth aspect of the present invention concerns a winding apparatus characterized in that the above-mentioned first and second movable bodies are guided by common guide means so as to come close to, and leave away from, each of the bobbins.

A fifth aspect of the present invention concerns a winding apparatus characterized in that the apparatus is provided with transfer means for carrying each of the bobbins to the above-mentioned holding means prior to winding and carrying the bobbin away from the holding means after winding.

Preferably, the bobbins supplied by a conveyer may be carried to their respective holding means by a robot and the rotation of the bobbins at the time of winding are effected by a single actuator. Further, the supply of wires is performed by synchronizing the plurality of nozzle units with the plurality of guide units thereby winding the wires around the plurality of bobbins and the wire-wound bobbins may be carried out to the conveyer.

A sixth aspect of the present invention concerns a winding apparatus characterized in that the above-mentioned transfer means clamps each of the bobbins by its chuck, carries the clamped bobbin to the holding means and then carries out the wire-wound bobbin.

A seventh aspect of the present invention concerns a winding apparatus characterized in that each of the bobbins is substantially funnel-shaped with the formation of a tapered outer peripheral surface having a projection and the holding means holds the bobbin through the projection.

In this case, there may be provided a concave receiving jig for receiving the projection on the funnel-shaped tapered outer peripheral surface of the bobbin and a bowllike holding jig for receiving the circular portion of the neck of the bobbin may be provided so as to maintain the bobbin holding accuracy.

In the mechanism for carrying out the work (i.e. bobbin) to the wire winding section from the wire supply section and for carrying out the bobbin from the wire winding section, a parallel chuck claw section for holding the projection on the bobbin may be made concave so that the bobbin is carried between the bobbin winding section and the bobbin discharging section. To enable such operation to be performed, the bobbin holding accuracy may be achieved by the provision of the projection on the outer peripheral surface of the funnel-shaped bobbin.

The winding apparatus according to the present invention is provided with a plurality of winding means each comprising a nozzle unit for winding and hooking the wire being supplied by clamping so that the wires from all the nozzle units are parallelly wound around the bobbins supplied to a plurality of holding means.

PREFERRED EMBODIMENTS OF THE INVENTION

One embodiment of a winding apparatus according to the present invention will now be described with reference to the accompanying drawings.

First, the entire structure of the winding apparatus provided with a plurality of winding units will be described by referring to FIGS. 1 and 2.

Figure 1:
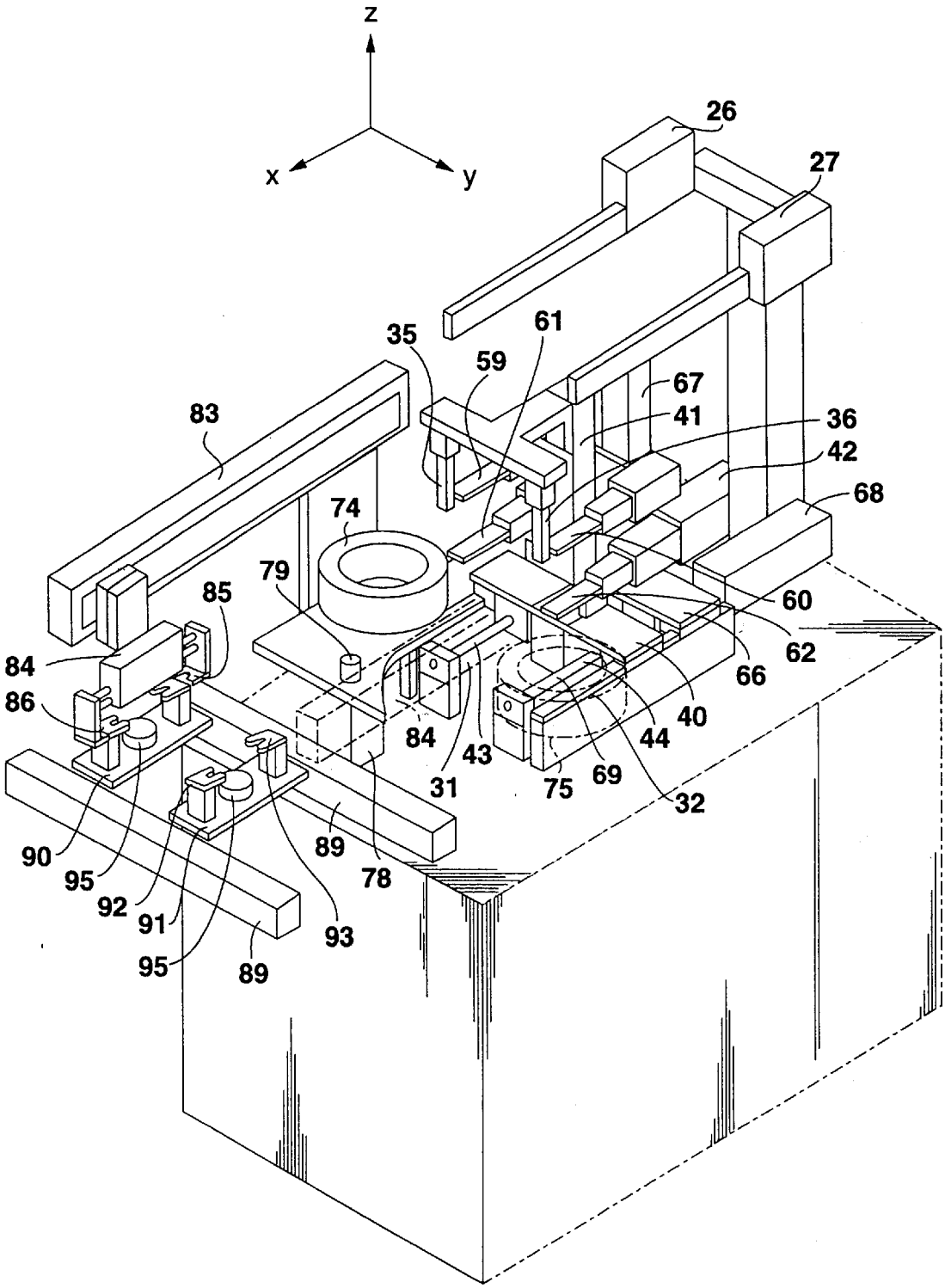
FIG. 1 is a perspective view of the entire structure of a winding apparatus according to the present invention.

FIG. 1 shows the entire structure of the winding apparatus for winding a coil for a deflection yoke of a CRT (cathode ray tube). The characteristic of this winding apparatus resides in that wires are wound around a plurality of works (yokes) simultaneously. A plurality of tensioners 26, 27 for supplying the wires under tension are provided. The wires are supplied to a pair of nozzle units 35, 36, respectively. Further, as shown in FIG. 2, the winding apparatus further includes a motor 48, a pulley, a power transmission belt, wire clampers 52, 53 and actuators 54, 55 for opening and closing the wire dampers 52,53, respectively. The nozzle units 35, 36 are mounted on a block 41 movable in the direction of the vertical axis Z and, by the operation of an actuator 44 mounted on a table 40, the pair of the nozzle units 35, 36 move upward.

The block 41 which supports the nozzle units 35, 36 while allowing them to move vertically is mounted on the table 40 which is movable forward and rearward, that is, along the X-axis.

In order to wind the wires 10 supplied by the pair of nozzle units 35, 36 in cooperation with the latters, there are provided four guide units 59, 60, 61 and 62. That is, in FIG. 2, there are provided upper and lower guide units 59, 61 in correspondence to the leftside nozzle unit 35 and there are also provided upper and lower guide units 60, 62 in correspondence to the rightside nozzle unit 36.

The guide units 59, 60 and 61, 62 are so supported that they can move upward in the direction of the Z-axis by the operation of an actuator 70 through a feed screw 69. Further, an actuator 67 is mounted at the back of a table 66 so that the guide units are made movable forward and rearward by an actuator 68 through a feed screw 69 and also by the operation of the actuator 70, the guide units 59, 60, 61, 62 move vertically, that is, in the direction of the Z-axis.

The table 40 on which the nozzle units 35, 36 are placed and the table 66 which supports the guide units 59, 60, 61, 62 are slidably supported on a pair of bilateral guide rails 31, 32, respectively, whereby the forward and rearward movements of the guide units 59, 60, 61, 62 by the actuator 68 and the forward and rearward movements of the nozzle units 35, 36 are made along the same straight line.

Figure 2:
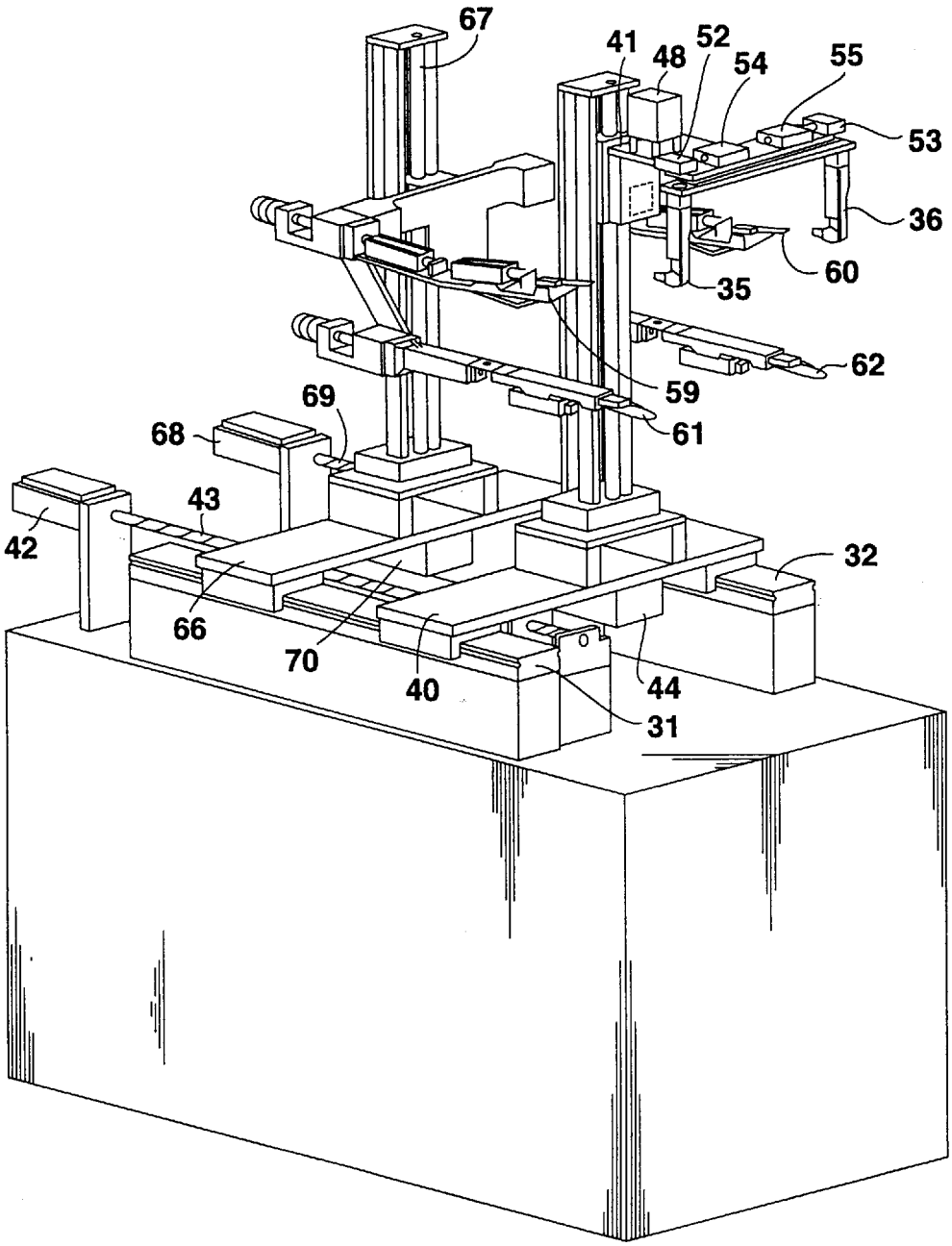
FIG. 2 is a perspective view of an essential portion of the winding apparatus of FIG. 1 showing particularly how a nozzle unit and a guide unit forming parts of the winding apparatus.

As will be clear from FIGS. 1 and 2, the pair of nozzle units 35, 36 forming two winding means, respectively, are movably supported on the movable body comprising the table 40 movable by the pair of bilateral guide rails 31, 32. In this case, the nozzle units 35, 36 are supported on a support member erected at the intermediate position between the guide rails 31, 32 in bilateral symmetry with each other. With such structure, the nozzle units 35, 36 are made movable by a common actuator 42 and made to have the same level of rigidity.

Further, the guide units 59, 61 on the side of the first winding means and the guide units 60, 62 on the side of the second winding means are supported on the table 66 movable on the guide rails 31, 32 with the guide units 59, 60 being supported in bilateral symmetry and the guide unit 61, 62 being supported in bilateral symmetry. Accordingly, the guide units 59, 60 have the same level of rigidity and the guide units 61, 62 have the same level of rigidity. Further, it becomes possible to move the four guide units 59 through 62 by the common motor 68. Thus, it becomes possible with this structure to make equal the qualities of windings on work-receiving pedestals 74, 75 (to be described later).

As shown in FIG. 1, at the winding positions in front of the nozzle units 35, 36 and the guide units 59, 60, 61, 62, there are arranged the above-mentioned work-receiving pedestals 74, 75, respectively. These work-receiving pedestals 74, 75 are provided with actuators 78 by the operations of which the pedestals 74, 75 are rotated to allow the wires 10 to be wound.

Figure 3:
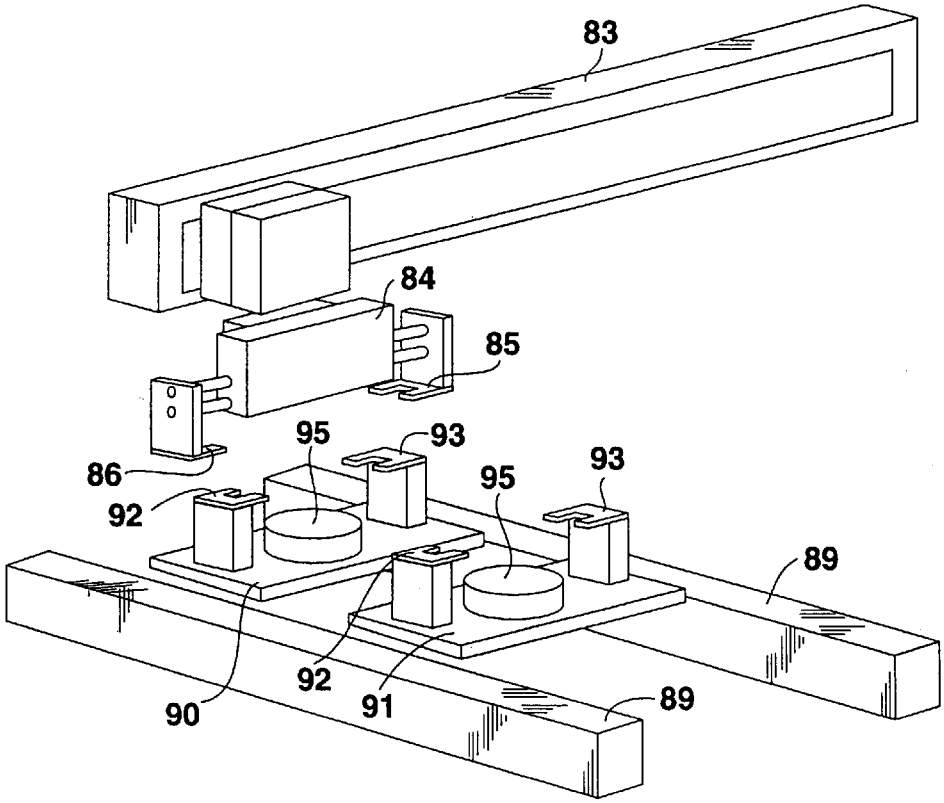
FIG. 3 is a perspective view of another essential portion of the winding apparatus of FIG. 1 showing particularly how bobbin transfer means of the apparatus is constructed.

Next, a conveyer 89 for supplying bobbins to the winding apparatus and a mechanism relating thereto will be described. As shown in FIGS. 1 and 3, in front of the winding apparatus there extends the conveyer 89 in the lateral direction and by this conveyer 89, pallets 90, 91 for carrying the bobbin are moved.

Figure 4:
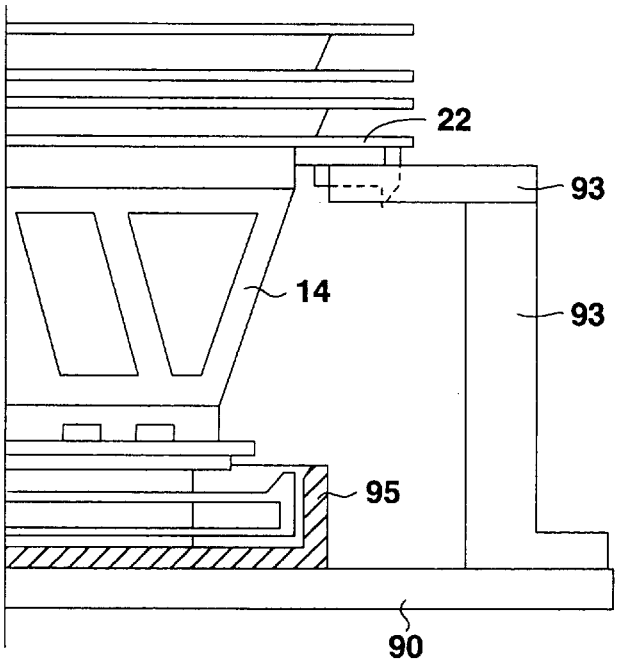
FIG. 4 is a front view of a mechanism for holding a bobbin by means of a pallet.
Figure 5:
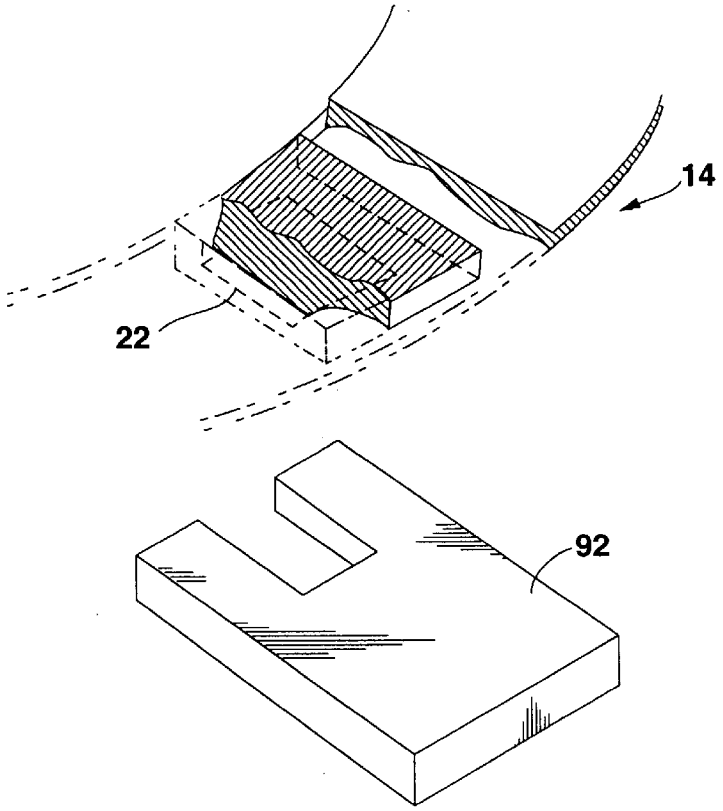
FIG. 5 is a diagram showing a relationship between a projection on the bobbin and a work receiving section of the pallet.

As shown in FIG. 3, the pallets 90, 91 are each provided with concavework-receivers 92, 93 (see FIGS. 4 and 5) and a ball-like guide 95 for receiving the neck portion of the bobbin. That is, as shown in FIGS. 4 and 5, a projection 22 of the bobbin is received into a recess of the receiver 93 of the pallet 90 so that the bobbin 14 is properly positioned. Particularly, it becomes possible to properly position the bobbin 14 not only in the direction of its height but also in the rotational direction thereof.

Figure 6:
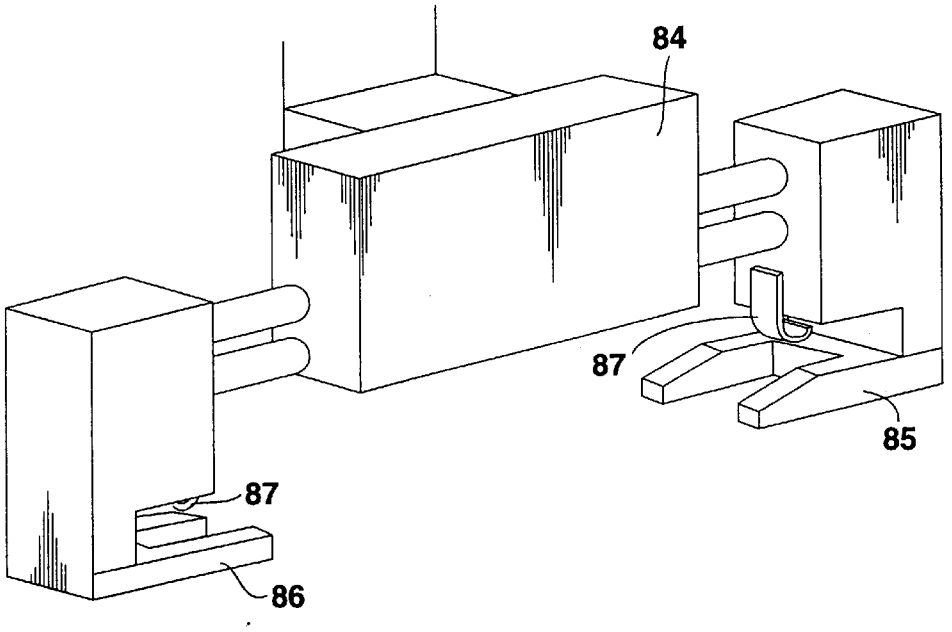
FIG. 6 is a perspective view of a parallel chuck.

Further, there are provided a pair of orthogonal robots 83 for moving the bobbins to their winding positions by taking them out from the pallets 90, 91. Each of these robots 83 is formed of a rodless cylinder so as to carry the bobbins to the pair of work-receiving pedestals 74, 75 shown in FIG. 1 and as shown in FIGS. 3 and 6, is provided with a parallel chuck 84 having at both ends thereof with concave work receiving sections 85, 86, respectively. Thus, the bobbins are carried in and out between the pallets 90, 91 and the work-receiving pedestals 74, 75. Note that in FIG. 1, a carrying mechanism corresponding to the pedestal 75 is omitted.

Figure 8:
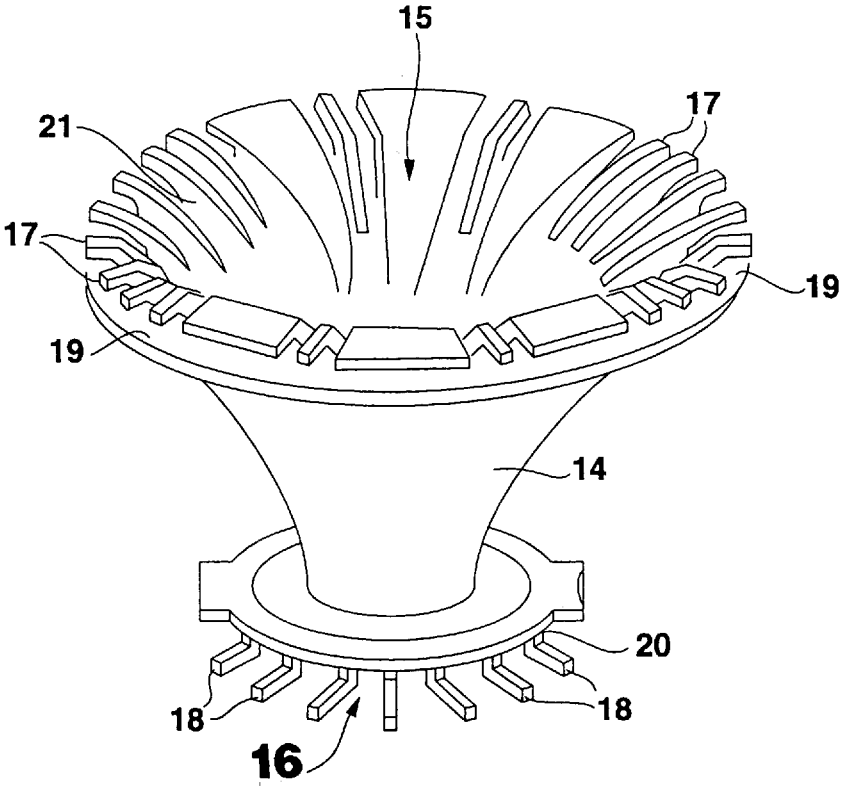
FIG. 8 is a perspective view of the bobbin.

Next, the bobbin 14 around which a deflection yoke coil is wound by the above-mentioned winding apparatus will be described by referring to FIG. 8. The bobbin 14 is funnel-shaped having a large opening 15 at the upper portion, and a lower opening 16 (see FIG. 9) at the lower portion, thereof. The upper opening 15 is provided at the outer periphery thereof with an engaging claw 17 while the lower opening 16 is provided at the outer periphery thereof with an engaging claw 18. Further, on the inner peripheral surface of the bobbin 14 there is formed a peripheral groove 19 and at the base portion of the engaging claw 18 there is formed another peripheral groove 20. Still further, the bobbin 14 is provided on the inner peripheral surface thereof with a winding groove 21.

Further, the bobbin 14 is provided below the collar of the funnel-shaped portion with a plurality of projections 22 shown in FIGS. 4 and 5 so that two such bobbins can be carried to the work-receiving pedestals 74, 75 of the wire winding section and can be held by the work-receiving sections 92, 93 of the pallets 90, 91.

Figure 12:
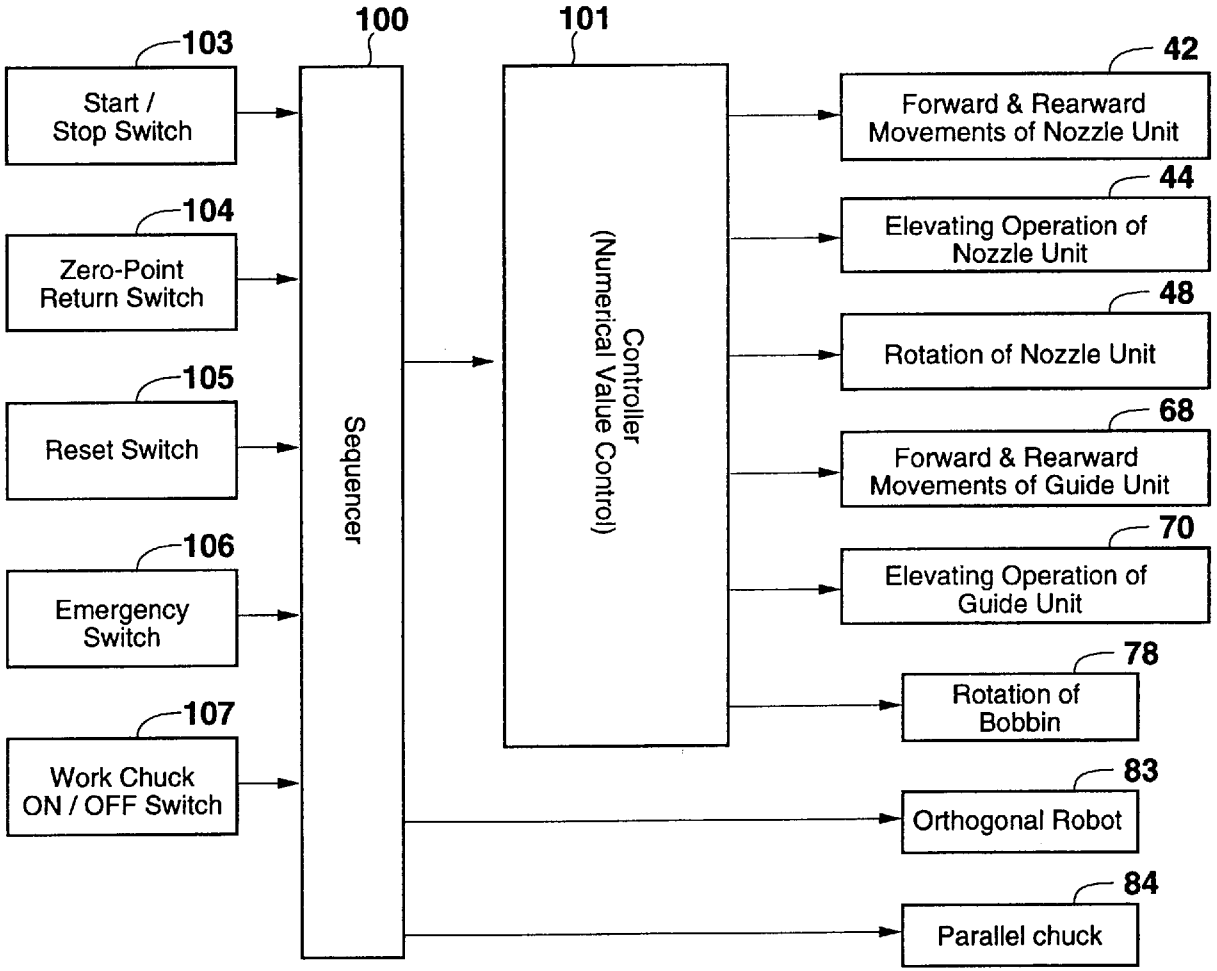
FIG. 12 is a block diagram of a control system of the winding apparatus according to the present invention.

Next, a control system for the above-mentioned winding apparatus will be described by referring to FIG. 12. This control system is provided with a sequencer 100 and a controller 101 formed of a numerical value controller. Further, to the input side of the sequencer 100, there are connected a start/stop switch 103, a zero-point return switch 104, a reset switch 105, an emergency stop switch 106 and a work chuck ON/OFF switch 107.

On the contrary, controlled by the controller 101, there are an actuator 42 for moving the nozzle unit forward and rearward, an actuator 44 for elevating the nozzle unit, a motor 48 for rotating the nozzle unit, an actuator 68 for moving the guide unit forward and rearward, an actuator 70 for elevating the guide unit and a motor 78 for rotating each bobbin. These actuators 42, 44, 48, 68, 70 and 78 are provided with encoders, respectively, and the output of each of these encoders is fed back to the controller 101. On the other hand, the orthogonal robot 83 and the parallel chuck 84 are directly controlled by the sequencer 100 without the intermediary of the controller 101.

Particularly, the winding operation in the above-described control system is performed by a combination of the six actuators 42, 44, 48, 68, 70 and 78 connected to the controller 101. On the contrary, the orthogonal robot 83 and the parallel chuck 84 perform bobbin supplying and discharging operations.

Next, the operation of the winding apparatus will be described. The wires 10 are supplied from the wire bobbins (not shown). The wires 10 are applied with a proper tensile force by tentioners 26, 27, pass through the housings of the nozzle units 35, 36 and are held by the top ends of the nozzles through the nozzle bodies thereby completing the preparation of winding of the wires 10.

Figure 7:
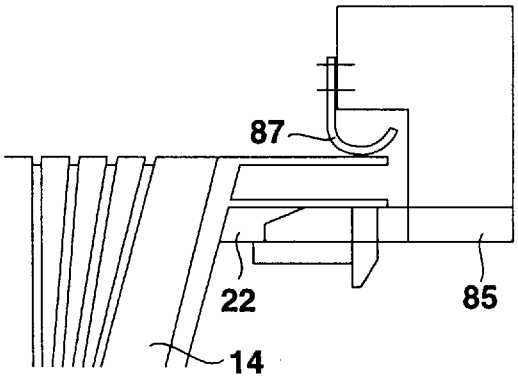
FIG. 7 is a front view of a mechanism for holding the projection on the bobbin by the parallel chuck.

The supply of the bobbins 14 is performed such that the projection 22 of each bobbin 14 (see FIG. 4) carried by the conveyer 89 and held by the concave bobbin-receivers 92, 93 of the pallet 90 is clamped by the concave bobbin-receivers 85, 86 of the parallel chuck 84 and at the same time, the collar of the bobbin 14 is pressed by springs 87 fixed to the bobbin mounting section (see FIGS. 6 and 7).

Next, the parallel chuck 84 moves up, then moves horizontally toward the bobbin-receiving pedestals 74, 75 and at a predetermined position, moves downward. Then, the parallel chuck 84 assumes a standby posture while it clamps the bobbin 14 at the work transfer position of the work-receiving pedestals 74, 75.

Then, the chuck (not shown) provided at the work-receiving pedestals 74, 75 moves forward by the operation of the actuator 78 and holds the projection 22 of the bobbin 14 held by the bobbin receiver 85 of the parallel chuck 84 as shown in FIG. 7. At this point, the parallel chuck 84 moves the work-receivers 85, 86 backward to release the bobbin 14 therefrom. After that, the parallel chuck 84 moves up and waits at its position until the winding of the wire around the bobbin 14 is complete.

Next, nozzle units 35, 36 have the top ends of the wires clamped by the guide units 59, 60, respectively, and the wires 10 are moved up to the wire holding sections of the work-receiving pedestals 74, 75 to thereby hold the terminating ends of the wires 10.

The nozzle units 35, 36 have the top ends thereof rotated by the actuator 48 shown in FIG. 2 and by the cooperative movements with the rotations of the bobbin-receiving pedestals 74, 75 effected by the actuator 78, rotating drive pulley 79 and the belt, the wire is wound around the funnel-shaped section of the bobbin 14. After that, the nozzles 35, 36 moved down within the respective bobbins 14 and lead the wires down to the necks of the bobbins. The winding of the wires at the necks of the bobbins is performed in such a manner that the lower guide units 61, 62 move forward to respectively hold the wires and the wires are wound at the necks of the bobbins 14 by the cooperative operations of the nozzles 35, 36, the work-receiving pedestals 74, 75 and the guide units 61, 62.

Figure 9:
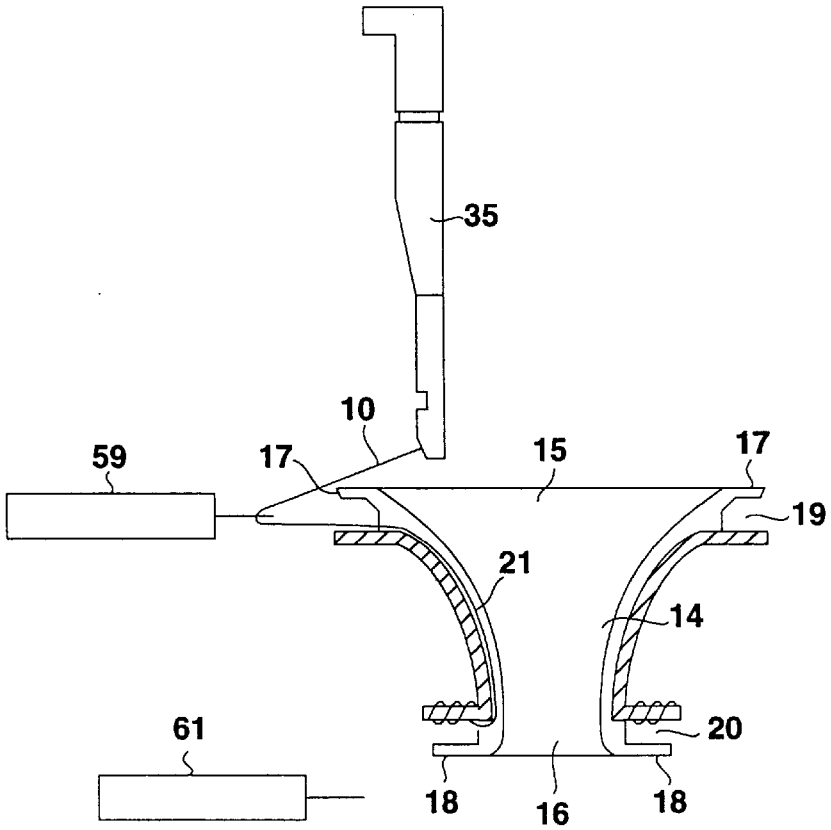
FIG. 9 is a vertical sectional view of the bobbin with the view being given for showing how a wire is wound around the bobbin.
Figure 10:
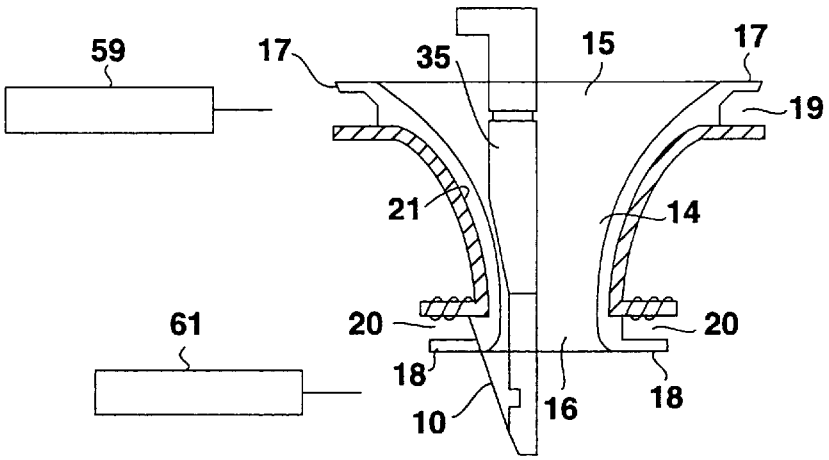
FIG. 10 is a vertical sectional view of the bobbin with the view being given for showing how the wire is wound around the bobbin.

To describe the invention in more detail, each of the wires 10 having its terminating end hooked by the pin is wound around winding groove 21 of each bobbin 14 shown in FIG. 9. After that, the nozzle 35 is moved to the center of the upper opening 15 of the bobbin as shown in FIG. 9 and then moved downward as shown in FIG. 10 so that the wire 10 is wound along the curved winding groove 21 of the bobbin 14. Then, when the wire 10 reaches the lower opening 16, it is hooked by a guide tip of the lower guide unit 61 and is wound along a peripheral groove 20 formed on the outer side of the lower opening 16. In this case, the work-receiving pedestals 74, 75 are rotated by an angle corresponding to the winding angle so that the bobbin 14 is rotated by a predetermined angle.

Figure 11:
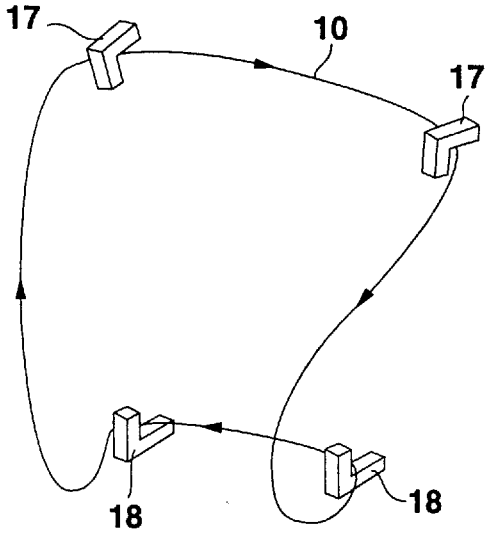
FIG. 11 is an illustration of a wire winding operation according to the present invention.

At a predetermined circumferential position, the wire 10 is released by the lower guide unit 61 whereupon the nozzle 35 moves upward and as shown in FIG. 9, it hooks the wire 10 around the upper guide unit 59 so as to wind the wire 10 by a predetermined angle along the peripheral groove 20 outside the upper opening 15 in cooperation with the rotation of the bobbin 14 following the rotation of the work-receiving pedestals 74, 75. Then, at a predetermined angular position, the guide tip of the guide unit 59 releases the wire 10 again and the nozzle 35 moves down along the Z-axis. Such operation is conceptually shown in FIG. 11. Thus, by repeating this operation by a predetermined number of times, the wire 10 is wound along the winding groove 21 inside the bobbin 14 to thereby form a saddlelike coil.

Upon completion of winding of the wire 10 with respect to the bobbin 14, the parallel chuck 84 which has been waiting at a position above the winding position moves down and the work-receivers 85, 86 move forward and upward while clamping the bobbin 14 therebetween and then carry the bobbin to the pallet 90. It is noted that since the above-described operation is performed with respect to the two bobbins 14 supplied to the pair of work-receiving pedestals 74, 75, two winding operations are performed simultaneously.

Next, another embodiment of the present invention will be described by referring to FIGS. 13 and 14. This embodiment enables the supply and discharge of the bobbins 14 to be performed by using a slide table 111 and a placing plate 112 instead of conveyers. On the slide table 111 there are placed a pair of bobbins 14 so as to correspond to the work-receiving pedestals 74, 75 and these bobbins 14 are supplied by the orthogonal robot 83.

Figure 13:
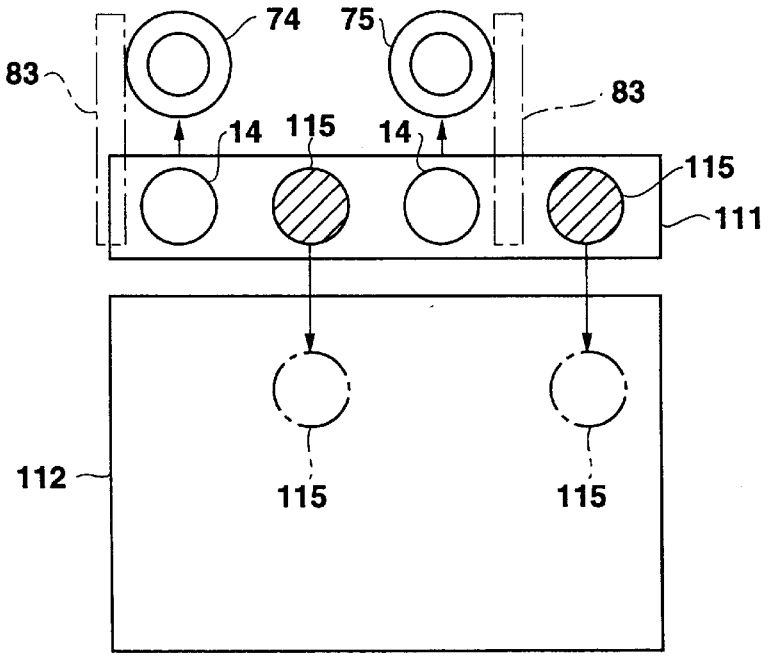
FIG. 13 is a plan view of a modification of the bobbin transfer device of FIG. 3.
Figure 14:
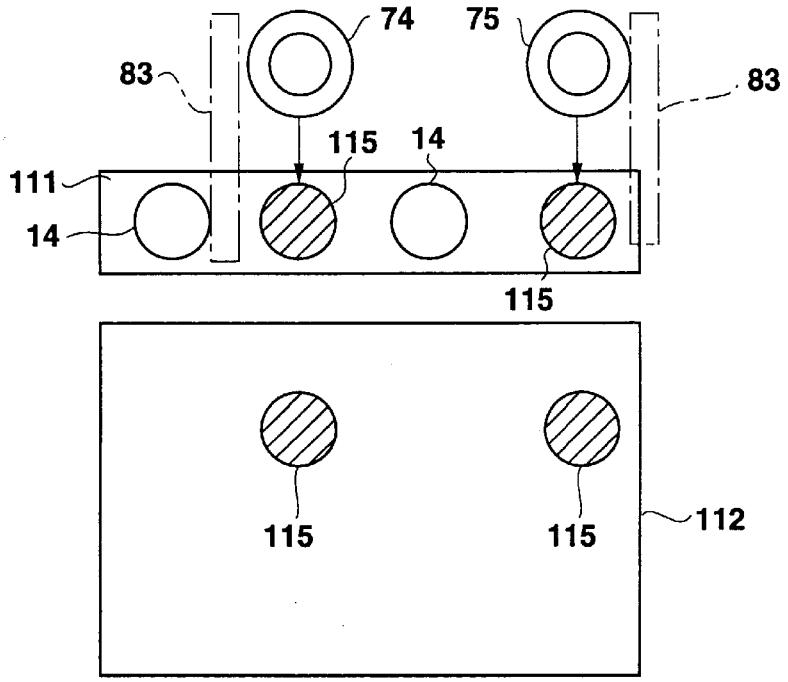
FIG. 14 is an illustration of how a wire-wound bobbin is discharged.

After that, the slide table 111 and the placing table 112 are moved from the position shown in FIG. 13 to the position shown in FIG. 14 and in this state, wire-wound bobbins 115 are transferred to the slide table 111 from the work-receiving pedestals 74, 75 by means of the orthogonal robot 83. These bobbins 115 are then manually placed on the placing table 112 by the operator.

With the above structure, if the wire-wound bobbins 115 are transferred from the slide table 111 during the winding operation at the work-receiving pedestals 74, 75 while empty bobbins 14 are placed on the slide table 111, it is possible to exchange the bobbins without any loss of time and to perform the supply and discharge of the bobbins without using a conveyer.

As described above, the present invention has the following various advantages. That is, (1) Since the winding apparatus of the present invention is provided with a plurality of sets of winding means for winding wires on a plurality of bobbins and a plurality of holding means for holding the bobbins in a predetermined posture with the holding means corresponding to the winding means, respectively, it is possible to wind the wires on the plurality of bobbins parallelly and sharply improve productivity without purchasing a plurality of units of the apparatus.

(2) Each of the winding means of the apparatus has its nozzle unit and guide unit arranged on the same guide rails such that the nozzle unit is arranged on the side of the center of each bobbin and the guide unit is arranged on the side of the outer periphery of the bobbin whereby the wire is supplied by the nozzle unit and the supplied wire is held engaged with the guide unit thereby winding the wire on the bobbin. Accordingly, it becomes possible to wind wires on a plurality of bobbins simultaneously in synchronism with each other and to parallelly process the wires by a simple structure.

(3) The winding apparatus of the present invention is provided with a pair of winding means each comprising a nozzle unit and a guide unit and arranged such that the nozzle units are supported in bilateral symmetry with respect to the moving direction thereon a first movable body capable of coming close to, and leaving away from, each bobbin while the guide units are supported in bilateral symmetry with respect to the moving direction thereof on a second movable body. Accordingly, it is possible to reduce the number of actuators and further, since the nozzle units and the guide units of the pair of winding means can have the same rigidity, it is possible to allow the windings by the pair of winding means to have the same quality thereby make the winding apparatus free of quality scattering.

(4) Due to the arrangement that the above-mentioned first and second movable bodies are guided by common guide means so as to come close to, and leave away from, each bobbin, it is possible to reduce the number of parts and to simplify the mechanism of the apparatus thereby increasing productivity.

(5) Since the winding apparatus of the present invention is provided with transfer means which carries each bobbin on the holding means and carries out each wire-wound bobbin from the holding means, it is possible to automatically perform the supply of each empty bobbin to the winding position and the carrying out of each wire-wound bobbin.

(6) Since the transfer section clamps the chuck section of each bobbin, carries the clamped bobbin on the holding means and carries the wire-wound bobbin out of the holding means, it is possible to increase the bobbin-holding accuracy by the transfer means and to achieve a highly reliable bobbin transfer.

(7) Since each bobbin is substantially funnel-shaped and has a projection on the outer peripheral surface thereof so as to allow the bobbin to be held while bobbin is positioned by the holding means through the projection, it is possible to carry the funnel-shaped bobbin with a high degree of holding accuracy.

What is claimed is:

1. A winding apparatus in which wire from a wire supply source is wound around a bobbin, said winding apparatus comprising a plurality of winding devices each comprising:

a nozzle unit;

an actuator for extending said nozzle unit along a straight line through an opening in a bobbin;

an upper guide unit and a lower guide unit for guiding wire being wound on said bobbin;

a holder for holding a bobbin in a predetermined position while wire is being wound on said bobbin, whereby said plurality of winding devices wind wire on a corresponding plurality of bobbins simultaneously.

2. A winding apparatus according to claim 1, wherein the nozzle units and the upper and lower guide units of said plurality of winding devices are all arranged on a common support which moves along guide rails.

3. A winding apparatus according to claim 1, wherein said nozzle units of said plurality of winding devices are supported on a common movable body for moving said nozzle units toward and away from bobbins on said holders of said plurality of winding devices.

4. A winding apparatus according to claim 1, wherein said nozzle units are supported on a common moveable support which is disposed on a table which moves along guide rails.

5. A winding apparatus according to claim 1, further comprising a robot which carries bobbins between a conveyor and said holders.

6. A winding apparatus according to claim 5, wherein said robot has a chuck for clamping a bobbin while said bobbin is being carried by said robot between said conveyor and said holders.

7. A winding apparatus according to claim 1, wherein said upper guide units and said lower guide units of said plurality of winding devices are actuated in common such that said upper guide units or said lower guide units are uniformly extended toward or uniformly retracted away from bobbins on said holders nozzle units of said plurality of winding devices.

8. A winding apparatus according to claim 1, wherein said upper and lower guide units of said plurality of winding devices are supported on a common support which is disposed on a table which moves along guide rails.

9. A winding apparatus in which a wire from a wire supply source is wound around a bobbin through a nozzle unit and a guide unit comprising a plurality of winding devices each comprising:

a nozzle unit;

an actuator for extending said nozzle unit through an opening in a bobbin;

an upper guide unit and a lower guide unit for guiding wire being wound on said bobbin;

a holder for holding a bobbin in a predetermined position while wire is being wound on said bobbin; and a robot which carries bobbins between a conveyor and said holders;

whereby said plurality of winding devices wind wire on a corresponding plurality of bobbins simultaneously; and wherein said robot comprises a pair of forks moveable toward and away from each other to grasp a bobbin, projections on an outer surface of the bobbin being received in said forks.

10. A winding apparatus according to claim 7, further comprising a spring disposed on at least one of said forks for clamping on a lip of a bobbin.

11. A winding apparatus in which a wire from a wire supply source is wound around a bobbin through a nozzle unit and a guide unit comprising a plurality of winding devices each comprising:

a nozzle unit;

an actuator for extending said nozzle unit through an opening in a bobbin;

an upper guide unit and a lower guide unit for guiding wire being wound on said bobbin;

a holder for holding a bobbin in a predetermined position while wire is being wound on said bobbin; and a robot which carries bobbins between a conveyor and said holders; whereby said plurality of winding devices wind wire on a corresponding plurality of bobbins simultaneously; and wherein said conveyor comprises a plurality of pallets for receiving bobbins and holding said bobbins while said bobbins are being transported by said conveyor.

12. A winding apparatus according to claim 11, wherein said pallets each comprise two opposed forks for receiving projections on opposite sides of said bobbins.

* * * * *

UNITED STATES PATENT AND TRADEMARK OFFICE

CERTIFICATE OF CORRECTION

PATENT NO. : 5,845,863
DATED : December 8, 1998
INVENTOR(S) : Hiroyuki TAKUBO and Hideaki KAWAURA It is certified that error appears in the above-identified patent and that said Letters Patent is hereby corrected as shown below:

Column 10, claim 10 should read--

10. A winding apparatus according to claim 9, further comprising a spring disposed on at least one of said forks for clamping on a lip of a bobbin.

--.

Signed and Sealed this

Twentieth Day of April, 1999

*Attest:*

Q. TODD DICKINSON

*Attesting Officer*

*Acting Commissioner of Patents and Trademarks*